United States Patent [19]

Chapin

[11] 4,224,964

[45] Sep. 30, 1980

[54] BINARY FLUIDIC COUNTER

[75] Inventor: Donald W. Chapin, Scottsdale, Ariz.

[73] Assignee: The Garrett Corporation, Los Angeles, Calif.

[21] Appl. No.: 872,691

[22] Filed: Jan. 26, 1978

[51] Int. Cl.[3] ..... F15C 1/12

[52] U.S. Cl. ..... 137/821; 235/201 PF

[58] Field of Search ..... 137/820, 821; 235/201 PF

[56] References Cited

U.S. PATENT DOCUMENTS

| | | | |
|---|---|---|---|
| 3,182,676 | 5/1965 | Bauer | 137/821 X |
| 3,243,113 | 3/1966 | Welsh | 137/821 |
| 3,399,829 | 9/1968 | Richards et al. | 137/821 |
| 3,433,408 | 3/1969 | Bellman et al. | 137/821 X |
| 3,486,692 | 12/1969 | Ahern | 137/821 X |
| 3,490,478 | 1/1970 | Brueler, Jr. | 137/821 |
| 3,554,205 | 1/1971 | Bellman | 137/821 X |
| 3,584,635 | 6/1971 | Warren | 137/820 X |

FOREIGN PATENT DOCUMENTS

| | | | |
|---|---|---|---|
| 1165281 | 9/1969 | United Kingdom | 137/820 |

*Primary Examiner*—William R. Cline

*Attorney, Agent, or Firm*—James W. McFarland; Albert J. Miller

[57] ABSTRACT

A binary fluidic counter which produces two outputs, each having a frequency one-half the frequency of the supply. The counter incorporates a pair of bi-stable fluidic amplifiers, the first receiving a pulsed fluid supply while the second receives a continuous fluid supply and has inputs directly connected with the outputs of the bi-stable director. The second bi-stable amplifier acts as a memory device. Feedback circuits respectively interconnect the outputs of the second memory device with the inputs of the first amplifier. Monostable fluidic OR gates interposed in the feedback circuits respectively permit and prevent interconnection of the outputs of the second amplifier with the inputs of the first amplifier in relation to the pulse signals being transmitted from the first to the second amplifier.

1 Claim, 2 Drawing Figures

BINARY FLUIDIC COUNTER

BACKGROUND OF THE INVENTION

1. Field of the Invention

The present invention pertains to fluidic counters and more particularly to binary fluidic counters having two outputs with feedback paths to indicate the presence of fluid flow in one output and transfer fluid flow to the other output.

2. History of Prior Art

Prior art has produced several types of binary counters, none of which have the reliability of the present invention. In general, the less complex fluidic binary counters are configuration dependent and require close tolerances in manufacturing, or they have oscillation problems, i.e. they will produce an alternating output in certain situations regardless of the input. The more complex fluidic binary counters have their deficiencies in both of the above areas with the added problem of complicated flow patterns.

Examples of prior art which pertain to the present invention are U.S. Pat. No. 3,182,676 to Bauer, U.S. Pat. No 3,490,478 to Brueler, U.S. Pat. No 3,223,101 to Bowles, U.S. Pat. No. 3,433,408 to Bellman et al, U.S. Pat. No. 3,243,113 to Welsh, U.S. Pat. No. 3,554,205 to Bellman, and U.S. Pat. No. 3,486,692 to Ahern.

BRIEF SUMMARY OF THE INVENTION

The present invention introduces a fluidic binary counter which is reliable, uncomplicated, and useful over a wide range of input frequencies. The present invention eliminates the problem of oscillation with positive blocking of transfer to a second output while the fluid flow is being directed to a first output. The problem of close tolerances is eliminated through the use of separate functional parts. The present invention eliminates complexity by using fewer functional parts. A first fluidic amplifier is used as a bistable director in conjunction with two fluidic OR gates to direct fluid flow in a second fluidic amplifier used as a fluidic bistable memory giving two memory outputs, each one having a frequency half the frequency of the director supply frequency.

DESCRIPTION OF THE PREFERRED EMBODIMENT

Figure 1:
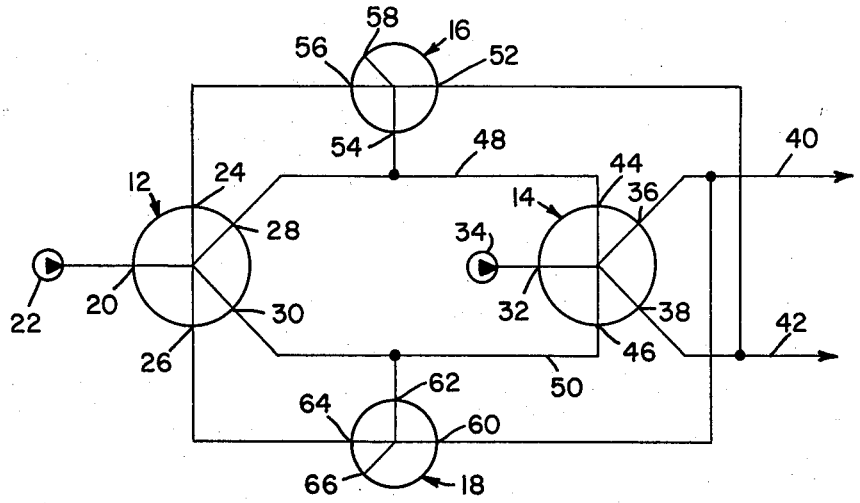
FIG. 1 is a schematic diagram of the preferred embodiment of the present invention.

FIG. 1 shows a fluidic counter stage illustrating the preferred embodiment having a fluidic bistable director 12, a fluidic bistable memory 14 and fluidic OR gates 16 and 18. Fluidic director 12 and fluidic memory 14 are both conventional bistable fluidic amplifiers capable of two outputs. The OR gates 16 and 18 are fluidic monostable amplifiers. Bistable director 12 receivers fluidic pulses at supply port 20 from fluid pulse source 22 and feedback inputs at input ports 24 and 26 and produces fluid outputs at output ports 28 and 30 in response thereto. Bistable memory 14 receives a continuous fluid supply through supply port 32 from fluid source 34 and produces outputs at output ports 36 and 38 to tubular ducts 40 and 42 respectively. Memory 14 also receives inputs at input ports 44 and 46 from the output ports 28 and 30 of director 12 through tubular actuator ducts 48 and 50 respectively. Output duct 42 is connected to the supply port 52 or OR gate 16 which receives an input at port 54 from actuator duct 48 and produces an output at output port 56 if no fluid pressure is present at input port 54. Output port 56 is connected to input port 24 of bistable director 12. Similarly, output duct 40 of bistable memory 14 is connected to supply port 60 of OR gate 18 which has its input port 62 connected to duct 50 and has an output port 64 which is connected to the input port 26 of bistable director 12 and an output port 66 which is vented.

In operation, bistable director 12 will receive fluidic pulses from pulse source 22 through input port 20. However, the preferred embodiment can accept any input and will produce outputs at duct 40 and 42 one-half the frequency of the input of fluid pulse source 22. The only input requirement is that it exceed a predetermined level after having decreased below this predetermined level to effect switchover from one output to the other. The input at port 20 will produce an output at port 28 which will be carried through actuator duct 48 to the input port 44 of bistable memory 14. The fluid pulse in actuator duct 48 will cause an increase in pressure at input port 54 or OR gate 16 which will deflect any supply coming in port 52 to output port 58. OR gates 16 and 18 are monostable amplifiers with stable states allowing fluid communication between supply port 52 and output port 56 and between supply port 60 and output port 64, respectively, when no input is present. A pulse at input port 44 will direct the supply coming into port 32 from source 34 to output port 38 and will cause the fluid flow to travel through duct 42. The increased fluid pressure in duct 42 will cause a fluid flow to supply port 52 of OR gate 16 which will be directed to output port 58 when a directing pulse is present in duct 48. When the pulse in duct 48 goes to zero, the supply at port 52 will pass through to output port 56 which, in turn, will travel to input port 24 of bistable director 12. Since fluid source 34 produces a continuous fluid flow the output through duct 42 will also be continuous and the signal at port 24 will likewise be continuous. An increased pressure at port 24 will direct the next fluidic pulse from pulse source 22 to output port 30 and the pulse will travel through duct 50 to input port 46 of bistable memory 14. The increased fluid pressure in duct 50 will cause an increase in pressure at input port 62 of OR gate 18 which directs the feedback signal from port 60 to output port 66. The increased pressure in duct 50 will also cause an increase in pressure at input port 46 which directs the fluid flow from source 34 to output port 36, causing a fluid flow in duct 40. The increased pressure in duct 40 will, in turn, cause an increase in pressure with its concomitant fluid flow at supply port 60 of OR gate 18. This fluid flow will be deflected to output port 66 while a directing fluid pulse is present in actuator duct 50. When the fluid pulse in duct 50 goes to zero the increase in pressure at input port 62 will also decrease to zero permitting fluid flow from supply port 60 to output port 64 which in turn will pass to input port 26 of director 12. Again, since the fluid supply from pump 34 is continuous, the fluid flow in output duct 40 is also continuous, thus producing a continuous pressure at input port 26 which directs the next pulse from pulse source 22 to output port 28 and the entire cycle will be repeated.

Figure 2:
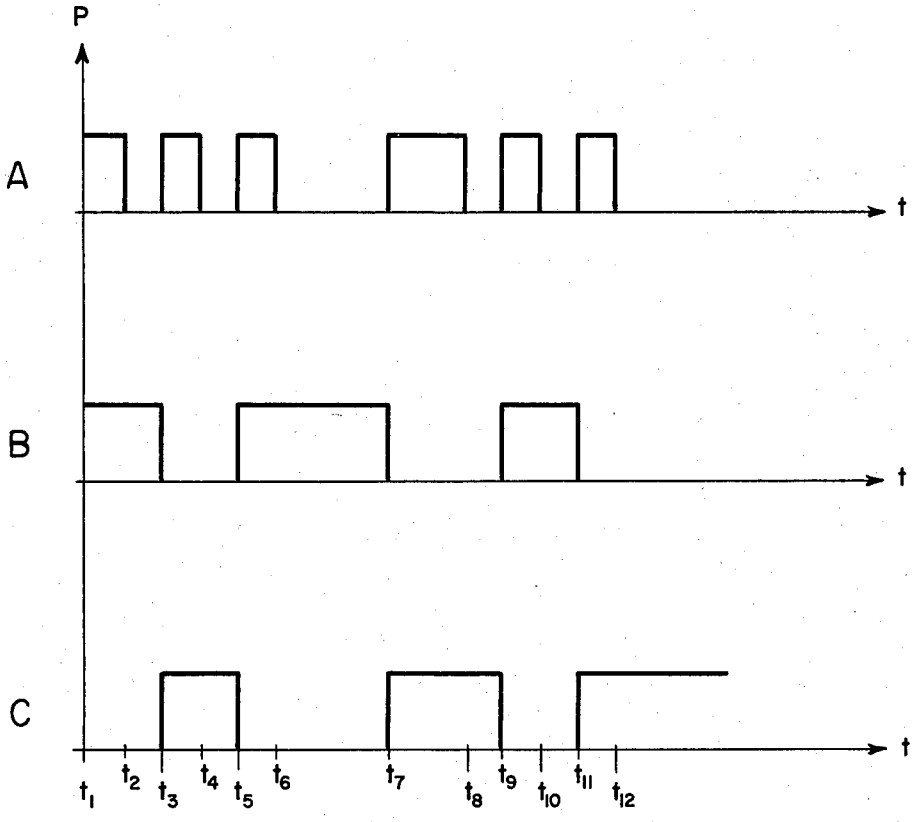
FIG. 2 is a series of graphical representations labeled A, B and C, depicting the input and outputs of the embodiment of FIG. 1.

Referring now to FIG. 2, the pulse input of pulse source 22 is shown in graph A while the outputs at ducts 42 and 40 are shown in graphs B and C, respectively. At time $t_1$, a director supply pulse is initiated and an output occurs at duct 42. At time $t_2$ the pulse is zero and the output continues. At time $t_3$ a second director pulse is initiated and the output shifts to duct 40. The next pulse is initiated at time $t_5$, shifting the output to duct 42 where it remains until the initiation of a fourth pulse. Each time a pulse is supplied to director 12, the output of memory 14 shifts and remains until the directive pulse goes to zero and a new pulse is issued.

At time $t_1$ the pulse is initiated from pulse source 22 which travels through duct 48 to direct the continuous fluid flow of source 34 to duct 42 as shown in graph B. An output will be present at duct 42 until time $t_3$, even though the pulse from pulse source 22 has decreased to zero at time $t_2$, since the fluid flow from source 34 is continuous. It should be noted that a pulse from pulse source 22 must decrease to zero before transfer can take place. The flow at duct 42 causes an increased pressure at input port 24 to direct the next pulse from pulse source 22 at time $t_3$ to duct 50. This pulse will in turn direct the fluid flow from source 34 to output duct 40 as can be seen in graph C from time $t_3$ to $t_5$, because the pulse from pulse source 22 has decreased to zero at time $t_4$. The increased pressure at duct 40 will cause an increase in pressure at input port 26 of direct or 12 to direct the next succeeding pulse at time $t_5$ to duct 48 and the output of memory 14 will again shift to output duct 42 as shown in graph B. The output at duct 42 will remain constant even though the third pulse from pulse source 22 has reduced to zero at time $t_6$. At time $t_7$ the fourth pulse is issued from pulse source 22 to direct the output to duct 40 as shown in graph C. The output will remain at either duct 40 or 42 until this fourth pulse decreases to zero and the next pulse is issued from pulse source 22. Thus, as shown in graphs A, B and C the output of memory 14 will shift each time a pulse is issued from pulse source 22 and the output will remain at duct 40 or 42 until another pulse is issued. This can be seen when viewing graphs A and C at time $t_{11}$. The sixth pulse from pulse source 22 was initiated at time $t_{11}$ and reduced at zero at time $t_{12}$. The initiation of pulse 6 shifted the output from duct 42 to duct 40 and since no succeeding pulse was issued the output remains continuous at duct 40 until either source 34 is turned off or an additional pulse is issued from pulse source 22.

As can be seen from the foregoing, a fluidic binary counter which is reliable, uncomplicated and useful over a wide range of frequency inputs is shown by the present invention. Through the use of OR gates, a positive block is inserted into the feedback paths of the binary outputs so that low frequency supplies can be used to direct the shifting of the bistable memory output without oscillations. Through the judicious use of few components the heretofore complexity of a reliable system is eliminated.

While a specific embodiment of the invention has been illustrated and described it is to be understood that the embodiment is by way of example only and that the invention is not to be construed as being limited thereto, but only by the proper scope of the following claims.

What is claimed is:

1. In combination:

a fluid pulse supply;

a continuous fluid supply;

director means for producing output pulses, said director means having a supply port connected to said fluid pulse supply, first and second input ports, and first and second output ports;

memory means for producing one of two outputs, each output having a frequency one-half the frequency of said fluid pulse supply, said memory means having a supply port connected to said continuous fluid supply, first and second input ports directly connected to said first and second output ports of said director means, and first and second output ports;

first feedback means for shifting said fluid pulse input to one of said first and second outputs of said director means, said first feedback means having a supply port connected to said second output port of said memory means, an input port connected between said first output of said director means and said first input of said memory means, a first vented output port, and a second output port connected to said first input port of said director means, said first feedback means responsive to the pressure condition within said input port thereof for operating in first and second states connecting said supply port of the first feedback means respectively with said second output thereof and said first vented output port thereof;

second feedback means for shifting said fluid pulse input to one of said first and second outputs of said director means, said second feedback means having a supply port connected to said first output port of said memory means, an input port connected between said second output of said director means and said second input of said memory means, a first vented output port and a second output port connected to said second input port of said director means, said second feedback means responsive to the pressure condition within said input port thereof for operating in first and second states connecting said supply port of the second feedback means respectively with said second output thereof and said first vented output thereof; and said first and second feedback means being operably arranged relative to said director means and said memory means whereby said first and second output ports of said director means are respectively in continuous, direct communication with said first and second input ports of said memory means at all times regardless of the operating states of said first and second feedback means.

* * * * *